US011162314B2

(12) United States Patent
Nguyen et al.

(10) Patent No.: US 11,162,314 B2
(45) Date of Patent: Nov. 2, 2021

(54) CASING EXIT ANCHOR WITH REDUNDANT ACTIVATION SYSTEM

(71) Applicants: Tuan Nguyen, Pearland, TX (US); Philip M. Gregurek, Pearland, TX (US)

(72) Inventors: Tuan Nguyen, Pearland, TX (US); Philip M. Gregurek, Pearland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 7 days.

(21) Appl. No.: 16/829,049

(22) Filed: Mar. 25, 2020

(65) Prior Publication Data

US 2021/0301610 A1 Sep. 30, 2021

(51) Int. Cl.

| | |
|---|---|
| ***E21B 23/01*** | (2006.01) |
| ***E21B 23/04*** | (2006.01) |
| ***E21B 29/06*** | (2006.01) |
| ***E21B 34/06*** | (2006.01) |
| ***E21B 37/04*** | (2006.01) |
| *E21B 19/10* | (2006.01) |
| *E21B 29/00* | (2006.01) |

(52) U.S. Cl.

CPC ..... *E21B 23/01* (2013.01); *E21B 23/04* (2013.01); *E21B 34/063* (2013.01); *E21B 37/045* (2013.01); *E21B 19/10* (2013.01); *E21B 29/005* (2013.01)

(58) Field of Classification Search

CPC ..... E21B 23/01; E21B 23/0411; E21B 23/04; E21B 23/042; E21B 29/06

See application file for complete search history.

(56) References Cited

U.S. PATENT DOCUMENTS

| | | | | |
|---|---|---|---|---|
| 3,409,096 | A * | 11/1968 | Brown | E21B 33/138 175/325.4 |
| 5,002,131 | A | 3/1991 | Cromar et al. | |
| 5,109,924 | A | 5/1992 | Juergens et al. | |
| 5,431,220 | A | 7/1995 | Lennon et al. | |
| 5,474,126 | A | 12/1995 | Lynde et al. | |
| 5,699,858 | A | 12/1997 | McAnally | |

(Continued)

FOREIGN PATENT DOCUMENTS

| | | | |
|---|---|---|---|
| EP | 0916014 | A1 | 5/1999 |
| WO | 2016209686 | A1 | 12/2016 |

OTHER PUBLICATIONS

"Timken introduces two high performance alloy steel grades" Offshore Magazine, Offshore Staff, Nov. 11, 2013 (pp. 1-5).

(Continued)

*Primary Examiner* — Cathleen R Hutchins

(74) *Attorney, Agent, or Firm* — Cantor Colburn LLP

(57) ABSTRACT

An anchor activation system including a housing having an outer surface, an inner surface defining an internal chamber, a first end, and a second end. A slip is shiftably mounted to the outer surface of the housing. The anchor activation system also includes a piston assembly and an activator mounted to the piston assembly. The activator selectively shifts the slip axially along the housing. A biasing member is arranged between the second end and the activator. A trigger is operable to selectively release the piston assembly.

13 Claims, 6 Drawing Sheets

(56) References Cited

U.S. PATENT DOCUMENTS

| | | | | |
|---|---|---|---|---|
| 5,709,265 | A | 1/1998 | Haugen et al. | |
| 5,803,176 | A | 9/1998 | Blizzard, Jr. et al. | |
| 5,878,818 | A * | 3/1999 | Hebert | E21B 23/01 166/382 |
| 6,032,740 | A | 3/2000 | Schnitker et al. | |
| 6,311,792 | B1 | 11/2001 | Scott et al. | |
| 6,464,002 | B1 | 10/2002 | Hart et al. | |
| 6,695,056 | B2 | 2/2004 | Haugen | |
| 7,878,253 | B2 | 2/2011 | Stowe et al. | |
| 8,327,944 | B2 | 12/2012 | King et al. | |
| 8,967,279 | B2 | 3/2015 | Hered et al. | |
| 9,140,083 | B2 | 9/2015 | Delgado et al. | |
| 10,227,823 | B2 | 3/2019 | Hern et al. | |
| 10,724,319 | B2 | 7/2020 | Hulsewe | |
| 2002/0170713 | A1 | 11/2002 | Haugen et al. | |
| 2004/0238171 | A1 | 12/2004 | McGarian et al. | |
| 2005/0039905 | A1 | 2/2005 | Hart et al. | |
| 2006/0207771 | A1 * | 9/2006 | Rios | E21B 23/01 166/382 |
| 2007/0044954 | A1 | 3/2007 | Dewey | |
| 2009/0266544 | A1 | 10/2009 | Redlinger et al. | |
| 2009/0266556 | A1 | 10/2009 | Swenson et al. | |
| 2010/0270031 | A1 | 10/2010 | Patel | |
| 2010/0307736 | A1 | 12/2010 | Hearn et al. | |
| 2010/0319997 | A1 | 12/2010 | King et al. | |
| 2012/0255785 | A1 | 10/2012 | Gregurek et al. | |
| 2012/0261193 | A1 | 10/2012 | Swadi et al. | |
| 2013/0020084 | A1 | 1/2013 | Goodson | |
| 2013/0299160 | A1 | 11/2013 | Lott | |
| 2015/0152703 | A1 | 6/2015 | Haun | |
| 2016/0238055 | A1 | 8/2016 | Donovan | |
| 2016/0348456 | A1 | 12/2016 | Laplante et al. | |
| 2017/0030168 | A1 | 2/2017 | Akkerman | |
| 2017/0328177 | A1 | 11/2017 | Sheehan et al. | |
| 2018/0209232 | A1 | 7/2018 | Hulsewe | |
| 2018/0209233 | A1 | 7/2018 | Hulsewe | |
| 2018/0320480 | A1 | 11/2018 | Jelly et al. | |
| 2018/0334872 | A1 | 11/2018 | Vuyk | |
| 2019/0003264 | A1 | 1/2019 | Swadi et al. | |
| 2019/0120005 | A1 | 4/2019 | Hulsewe | |
| 2019/0330944 | A1 | 10/2019 | Crabb et al. | |
| 2020/0011134 | A1 | 1/2020 | Nevlud et al. | |
| 2020/0018131 | A1 | 1/2020 | Telfer et al. | |
| 2020/0088001 | A1 | 3/2020 | Morland | |

OTHER PUBLICATIONS

C95400 Product Spec Sheet; Concast Metal Products, Jul. 27, 2010 (pp. 1-2).

C95510 Product Spec Sheet; Concast Metal Products, Dec. 22, 2010 (pp. 1-2).

Notification of Transmittal of the International Search Report and the Written Opinion of the International Searching Authority, or the Declaration; PCT/US2017/066117; dated Mar. 29, 2018; 13 pages.

Notification of Transmittal of the International Search Report and the Written Opinion of the International Searching Authority, or the Declaration; PCT/US2017/066119; dated Mar. 29, 2018; 10 pages.

* cited by examiner

CASING EXIT ANCHOR WITH REDUNDANT ACTIVATION SYSTEM

BACKGROUND

In the drilling and completion industry, boreholes are formed in a formation for the purpose of locating, identifying, and withdrawing formation fluids. Once formed, a casing may be installed in the borehole to support the formation. Often times, it is desirable to create a branch from the borehole. A whipstock is used to guide a window mill supported on a drillstring through the casing into the formation at an angle relative to the borehole. The whipstock directs the window mill to form a window or opening in the casing.

Generally, a window milling system is lowered into the borehole to a selected depth. Once in position, an anchor is deployed to lock the whipstock to the casing. Typically, an activation system shifts a slip axially along a tubular. The slip radially expands and bites into the casing. The activation system may take the form of a hydrostatic actuator, a hydraulic actuator, or a mechanical weight set. If the actuator fails, the drill string must be removed from the borehole for repair. Removing the drillstring to repair the actuator is a time consuming process. Given the need to increase efficiency at the rig floor, the art would be open to new systems for actuating an anchor for a casing window milling system.

SUMMARY

Disclosed is an anchor activation system including a housing having an outer surface, an inner surface defining an internal chamber, a first end, and a second end. A slip is shiftably mounted to the outer surface of the housing. The anchor activation system also includes a piston assembly and an activator mounted to the piston assembly. The activator selectively shifts the slip axially along the housing. A biasing member is arranged between the second end and the activator. A trigger is operable to selectively release the piston assembly.

Also disclosed is a method of activating an anchor with an anchor activation system. The method includes introducing a first activation force to a trigger, sensing that the first activation force did not activate the anchor, and introducing a second activation force to the trigger without reconfiguring the anchor activation system to activate the anchor.

Further disclosed is a method of activating an anchor with an anchor activation system. The method includes positioning a whipstock at a first position in a wellbore, introducing an activation force to a trigger thereby releasing a constrained energy source, shifting a slip with the constrained energy source into contact with a wellbore surface, and rotating the anchor after shifting the slip into contact with the wellbore surface.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
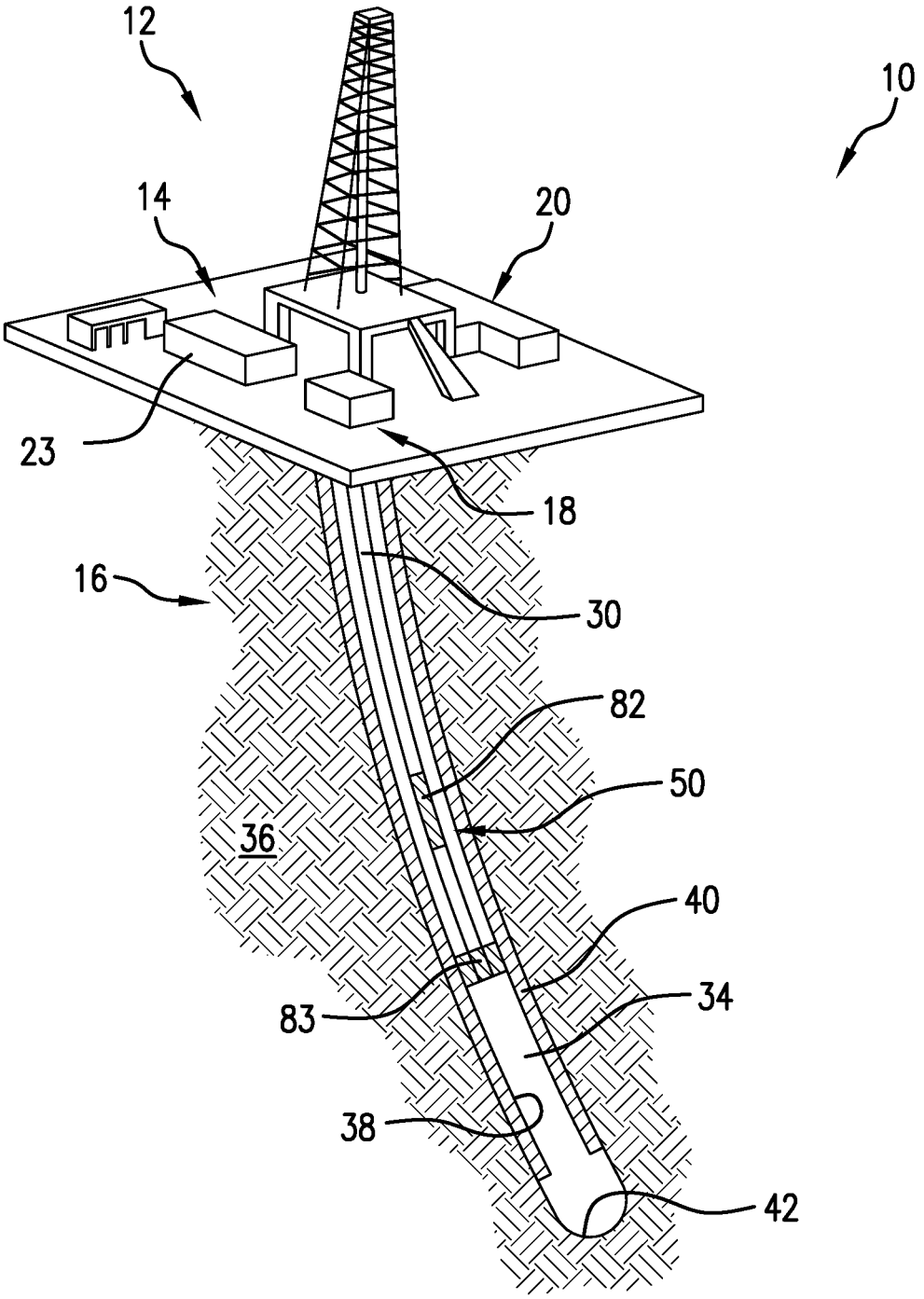
FIG. 1 depicts a resources exploration and recovery system including a redundant activation system, in accordance with an exemplary embodiment.

A resource exploration and recovery system, in accordance with an exemplary embodiment, is indicated generally at 10, in FIG. 1. Resource exploration and recovery system 2 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
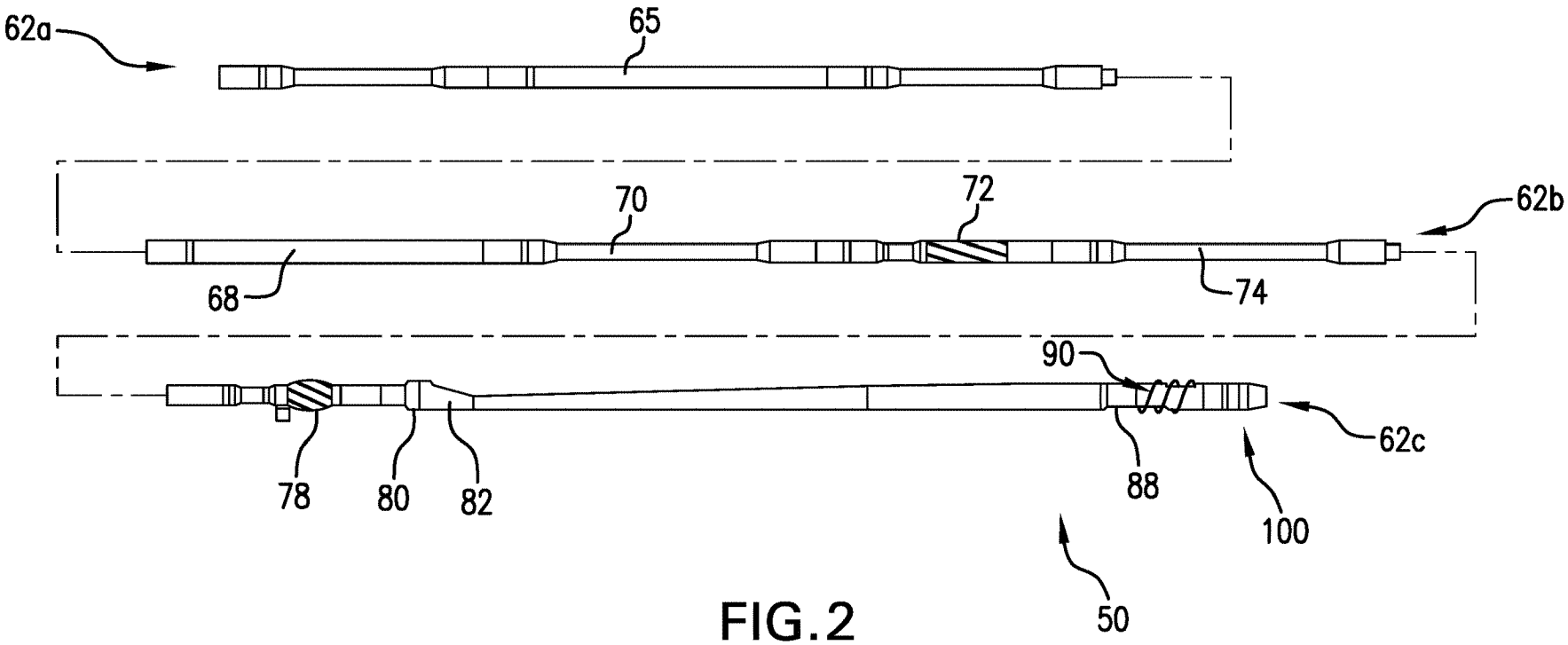
FIG. 2 depicts a window cutting system including a window mill and whipstock connector, in accordance with an exemplary embodiment.

In accordance with an exemplary aspect, a window cutting system 50 is connected to tubular string 30 as is introduced into wellbore 34. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. Each segment 62*a*, 62*b*, and 62*c* may be made up off-site and delivered to first system 12 for introduction into wellbore 34.

In an embodiment, first segment 62*a* may support a measurement while drilling (MWD) system 65 that includes various instrumentation systems that monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock connector 82, a whipstock 84, and an anchor 88. A scraper or brush 90 may be arranged on third segment 62*c* adjacent to anchor 88. Scraper or brush 90 may engage annular wall 38 so as to remove cement, debris or the like prior to activation of anchor 88. Whipstock connector 82 serves as an interface between window mill 80 and whipstock 84. As will be detailed herein, anchor 88 includes a redundant activation system 100. Redundant anchor activation system 100 may activate anchor 88 using secondary activation methodologies without the need to reconfigure components of third segment 62*c*.

Figure 3:
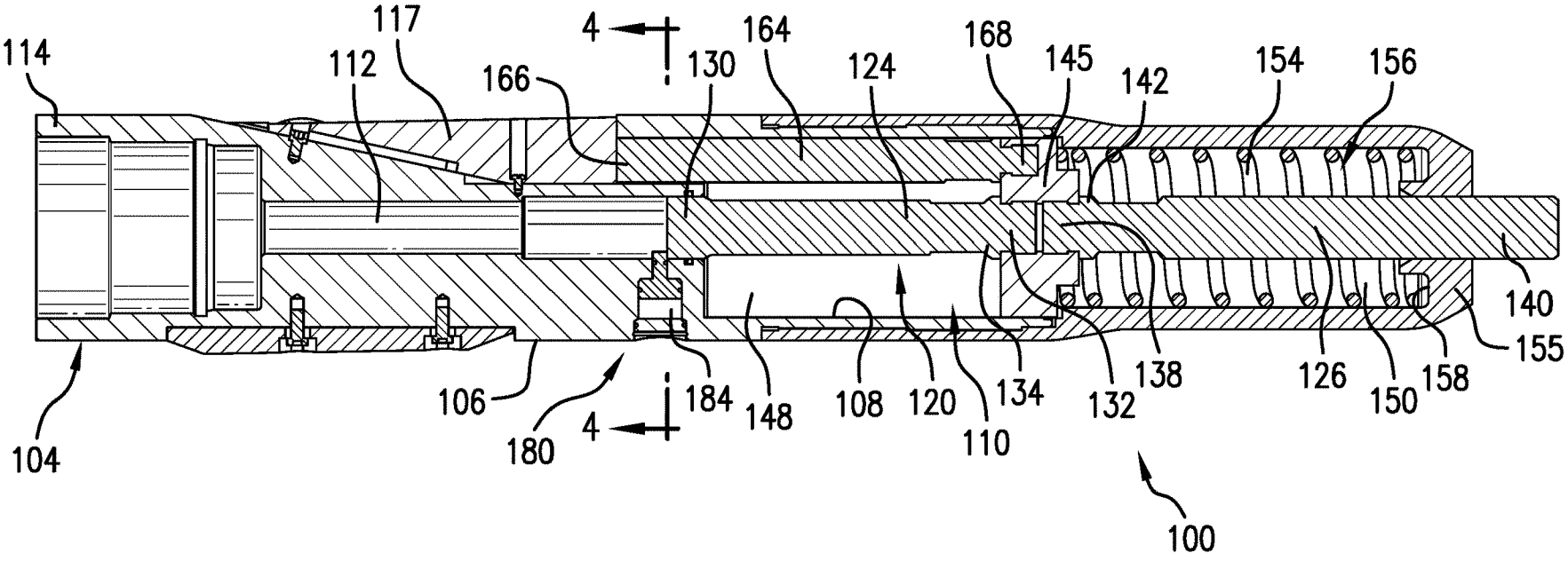
FIG. 3 depicts cross-sectional side view of an activation system in a run-in configuration, in accordance with an aspect of an exemplary embodiment.

Referring to FIG. 3, in an embodiment, anchor activation system 100 includes a housing 104 having an outer surface 106 and an inner surface 108 that defines an internal chamber 110. A passage 112 extends from a first axial end 114 of housing 104 and fluidically connects with internal chamber 110. A slip 117 is mounted to outer surface 106. A piston assembly 120 is arranged within housing 104.

In accordance with an exemplary embodiment, piston assembly 120 includes a first piston element 124 and a second piston element 126. First piston element 124 includes a first end 130 that extends into passage 112 and a second end 132. A first radially outwardly projecting lip 134 is arranged on first piston element 124 near second end 132. Second piston element 126 includes a first end portion 138 and a second end portion 140. Second end portion 140 projects axially outwardly of housing 104. A second radially outwardly projecting lip 142 is arranged on second piston element 126 near first end portion 138. An activator 145 is arranged between first piston element 124 and second piston element 126. Activator 145 is constrained between first radially outwardly projecting lip 134 and second radially outwardly projecting lip 142 and divides internal chamber 110 into a first chamber portion 148 and a second chamber portion 150.

A biasing member, which may take the form of a constrained energy device 154 is arranged in second chamber portion 150 between a second axial end 155 of housing 104 and activator 145. Second axial end includes an inner surface 158. Constrained energy device 154 may take the form of a coiled spring 156 but could take on many forms including compressed fluid and the like. A slip ram 164 extends between activator 145 and slip 117. Slip ram includes a first end portion 166 that abuts slip 117 and a second end portion 168 that is coupled to activator 145. Slip ram 164 sets slip 117 when acted upon by activator 145.

Figure 4:
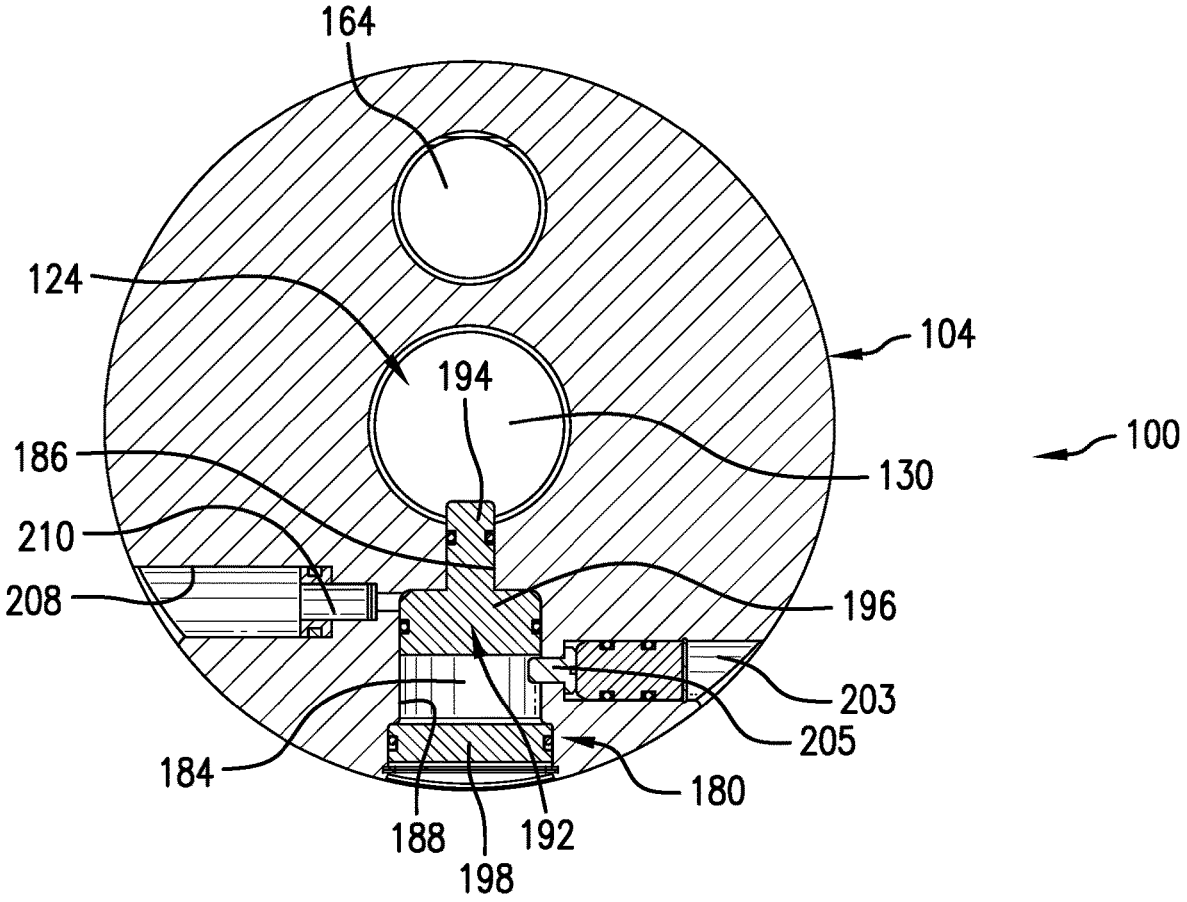
FIG. 4 depicts a cross-sectional axial end view of the activation system of FIG. 3 taken along the lines 4-4, in accordance with an exemplary embodiment.

In accordance with an exemplary embodiment, anchor activation system 100 include a trigger 180 that selectively releases piston assembly 120 allowing activator 145 to shift slip 117 through slip ram 164. Referring to FIG. 4, housing 104 includes a piston cylinder 184 that extends radially inwardly from outer surface 106 into passage 112. Piston cylinder 184 includes a first cylinder portion 186 having a first diameter (not separately labeled) and a second cylinder portion 188 having a second diameter (also not separately labeled) that is smaller than the first diameter.

A piston 192 is arranged in piston cylinder 184. Piston 192 defines a trigger and includes a first piston portion 194 and a second piston portion 196. First piston portion 194 includes a first diameter that is corresponds to the first diameter (not separately labeled) of first cylinder portion 186 and second piston portion 196 includes a second diameter that corresponds to the second diameter of second cylinder portion 188. A plug 198 is arranged in piston cylinder 184 trapping an amount of air radially outwardly of piston 192 forming an atmospheric chamber (not separately labeled).

In an embodiment, a channel 203 extends radially into housing 104 and connects with first cylinder portion 186. A shear element 205 is arranged in channel 203. Shear element 205 selectively prevents piston 192 from shifting radially outwardly through piston cylinder 184. A trigger passage 208 extends radially into housing 104 and connects with second cylinder portion 188. Trigger passage 208 terminates at an interface between first cylinder portion 186 and second cylinder portion 188. A burst disc 210 is arranged in trigger passage 208. Burst disc 210 selectively fluidically isolates piston cylinder 184 from annular pressure.

In an embodiment, tubular string 30 is run into wellbore 34 to position window mill 80 at a selected depth. Once in position, a first activation methodology will be initiated. Annular pressure, e.g., the pressure within wellbore 34 around tubular string 30 is increased to a selected level so as to cause burst disc 210 to rupture. Fluid pressure may then enter piston cylinder 184 at the interface between first cylinder portion 186 and second cylinder portion 188 and act upon piston 192.

The fluid pressure causes piston 192 move radially outwardly and break shear element 205 allowing first piston portion 194 to disengage from first end 130 of first piston element 124 thereby releasing piston assembly 120. Constrained energy device 154 then acts on activator 145 causing slip 117 to shift axially upwardly and radially outwardly into engagement with annular wall 38.

At this point, operators will shift tubular string 30 in wellbore 34 to sense whether slip 117 has been activated. If tubular string 30 moves, a second activation methodology may be employed without the need to remove tubular string 30 from wellbore 34 or reconfigure anchor activation system 100.

In the event that the first activation methodology fails, such as due to a failure of burst disc 210 to rupture, pressure may be increased within tubular string 30. The fluid pressure travels down through tubular string 30 and passes into first axial end 114 of housing 104. The fluid pressure then flows into passage 112 and acts upon first piston portion 194 forcing piston 192 against shear element 205. Piston 192 breaks shear element 205 allowing piston 192 to shift radially outwardly thereby releasing piston assembly 120. Constrained energy device 154 then acts on activator 145 causing anchor to shift axially upwardly and radially outwardly into engagement with annular wall 38.

Operators will again shift tubular string 30 in wellbore 34 to sense whether anchor 88 has been activated. If tubular string 30 moves, a third activation methodology may be employed without the need to remove tubular string 30 from wellbore 34 or reconfigure anchor activation system 100.

In the event that the second setting methodology fails, a third activation methodology may be employed. In this case, tubular string 30 is shifted further into wellbore 34. Anchor activation system 100 is brought into contact with toe 42 of wellbore 34 causing piston assembly 120 to shift axially upwardly driving first piston element axially upwardly causing shear element 205 to break. At this point, constrained energy device 154 may drive activator 145 into connect with slip 117. As discussed herein, activator 145 urges slip 117 along an angled surface portion (not separately labeled) of outer surface 106. Slip 117 expands radially outwardly into contact with annular wall 38 to maintain tubular string 30 at a desired position.

Figure 5:
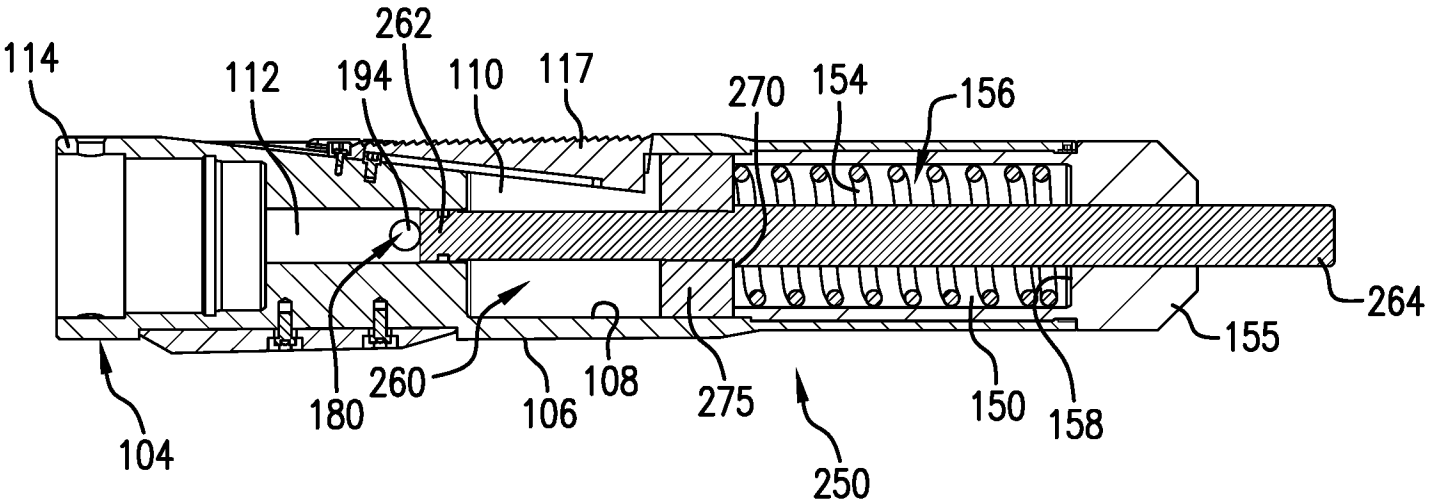
FIG. 5 depicts a cross-sectional side view of an activation system in a run-in configuration, in accordance with another aspect of an exemplary embodiment.

Reference will now follow to FIG. 5, wherein like reference numbers represent corresponding parts in the respective views, in describing an activation system 250 in accordance with another aspect of an exemplary embodiment. Activation system 250 includes a piston assembly 260 having a first end 262 that extends into passage 112 and a second end 264 that projects axially outwardly of second axial end 155 of housing 104. Piston assembly 260 includes a step portion 270 arranged between first end 262 and second end 264. An activator 275 is arranged at step portion 270.

In the embodiment shown, constrained energy device 154 is arranged between inner surface 158 of second axial end 155 and activator 275. First end 262 is selectively constrained by first piston portion 194 of trigger 180. With this arrangement, trigger 180 may be activated to release piston assembly 260 allowing constrained energy device to force activator 275 against slip 117 thereby anchoring window cutting system 50 in wellbore 34. In a manner similar to that discussed herein, as an alternative, tubular string 30 may be shifted further into wellbore 34. Anchor activation system 250 and, more specifically, second end 264 of piston assembly 260, is brought into contact with toe 42 of wellbore 34. Piston assembly 260 is shifted axially upwardly causing first piston portion 194 to break allowing constrained energy device 154 to shift activator 275 into contact with slip 117.

Figure 6:
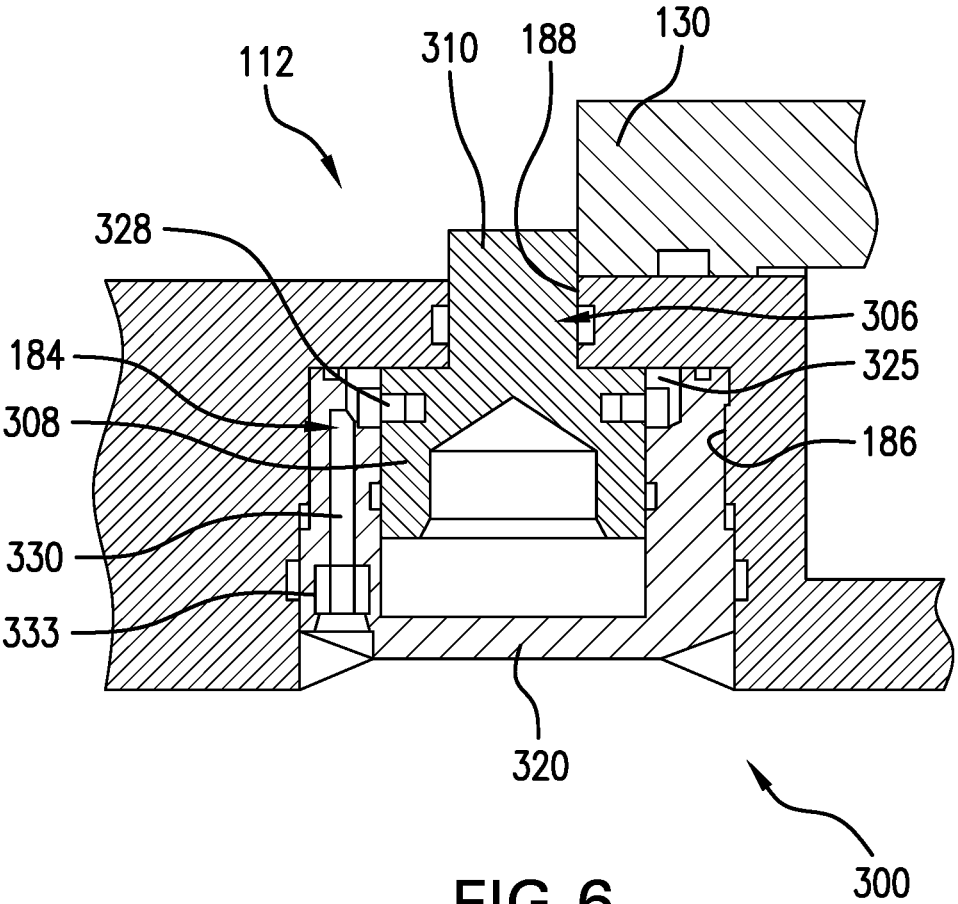
FIG. 6 depicts a cross-sectional side view of a trigger for the activation system, in accordance with an aspect of an exemplary embodiment.

Reference will now follow to FIG. 6, wherein like reference numbers represent corresponding parts in the respective views, in describing a trigger 300 in accordance with another aspect of an exemplary embodiment. Trigger 300 selectively releases piston assembly 120 allowing activator 145 to shift slip 117 through slip ram 164. Of course, it should be understood, that trigger 300 could also be used in combination with activation system 250.

Trigger 300 includes a piston 306 arranged in piston cylinder 184. Piston 306 includes a first piston portion 308 and a second piston portion 310. First piston portion 308 includes a first diameter that is corresponds to the first diameter (not separately labeled) of first cylinder portion 186 and second piston portion 310 includes a second diameter that corresponds to the second diameter of second cylinder portion 188. A plug or cap 320 is arranged in piston cylinder 184 trapping an amount of air radially outwardly of piston 306 forming an atmospheric chamber (not separately labeled).

A chamber 325 is arranged between first cylinder portion 186 and second cylinder portion 188. A shear element 328 locks piston 306 in piston cylinder 184. In the embodiment shown, a passage 330 extends through cap 320. A burst disc 333 selectively fluidically isolates passage 330 from, for example, wellbore 34. It should be understood, that trigger 300 may also function without burst disc 333. In operation, fluid pressure may be raised in wellbore 34 causing burst disc 333 to fracture. Fluid may pass through passage 330 and flow into chamber 325. Pressure in chamber 325 acts against piston 306 causing shear element 328 to fail allowing second piston portion 310 to shift radially outwardly to release piston assembly 120.

In accordance with an exemplary embodiment, anchor activation system 100 may be employed in a window milling operation. After being deployed into wellbore 34 to a selected position, an activation force is delivered to trigger 180 to release constrained energy device 154. Slip(s) 117 are shifted into contact with casing tubular 40 by the constrained energy device. After shifting slips(s) 117 into contact with casing tubular 40, anchor 88 is rotated to position whipstock 84 at a selected orientation and set down weight is applied. At this point, window mill 80 may be deployed to mill a casing window in casing tubular 40.

After milling the casing window into casing tubular 40, whipstock 84 can be released from wellbore casing by applying an overpull force to tubular string 30. At this point, whipstock 84 may be relocated higher in wellbore 34 to initiate another window milling operation. The whipstock may be locked in place through anchor 88 by applying set down weight. At the higher location, whipstock 84 may be at a different angular orientation. The angular position or orientation of whipstock 84 may be determined by MWD system 65 or another telemetry system. At this point, the other window may be milled into casing tubular 40.

At this point, it should be appreciated that the exemplary embodiments describe a system for activating a downhole anchor using redundant activation methodologies. The particular order of the activation methodologies may vary. Further the number of activation methodologies attempted for any given anchor activation operation may vary. That is the anchor activation system may be deployed once and, in the event that a primary activation methodology fails to activate the anchor, one or more backup activation methodologies may be employed without the need to remove the tubular string from the wellbore or reconfigure the anchor activation system.

Set forth below are some embodiments of the foregoing disclosure:

Embodiment 1. An anchor activation system comprising: a housing including an outer surface, an inner surface defining an internal chamber, a first end, and a second end; a slip shiftably mounted to the outer surface of the housing; a piston assembly; an activator mounted to the piston assembly, the activator selectively shifting the slip axially along the housing; a biasing member arranged between the second end and the activator; and a trigger operable to selectively release the piston assembly.

Embodiment 2. The anchor activation system according to any prior embodiment, wherein the piston assembly includes a first piston element and a second piston element, the first piston element including a first end engaged with the trigger and a second end extending into the activator.

Embodiment 3. The anchor activation system according to any prior embodiment, wherein the second piston element includes a first end portion extending into the activator and a second end portion projecting axially outwardly of the housing.

Embodiment 4. The anchor activation system according to any prior embodiment, further comprising: a slip ram extending between the activator and the slip.

Embodiment 5. The anchor activation system according to any prior embodiment, wherein the biasing member comprises a constrained energy device.

Embodiment 6. The anchor activation system according to any prior embodiment, wherein the constrained energy device comprises a spring.

Embodiment 7. The anchor activation system according to any prior embodiment, further comprising: a piston cylinder extending radially through the outer surface of the housing to the internal chamber.

Embodiment 8. The anchor activation system according to any prior embodiment, wherein the trigger comprises a piston arranged in the piston cylinder.

Embodiment 9. The anchor activation system according to any prior embodiment, further comprising: a shear element affixing the piston in the piston cylinder.

Embodiment 10. The anchor activation system according to any prior embodiment, further comprising: a trigger passage extending though the housing and fluidically connected to the piston cylinder.

Embodiment 11. The anchor activation system according to any prior embodiment, further comprising: a burst disc arranged in the trigger passage.

Embodiment 12. The anchor activation system according to any prior embodiment, wherein the piston assembly includes a first end selectively abutting the trigger and a second end that extends axially outwardly of the housing.

Embodiment 13. The anchor activation system according to any prior embodiment, wherein the piston assembly includes a step portion arranged between the first end and the second end, the step portion supporting the activator.

Embodiment 14. The anchor activation system according to any prior embodiment, wherein the activator directly abuts the slip.

Embodiment 15. The anchor activation system according to any prior embodiment, further comprising: a tubular mechanically connected to the housing, the tubular supporting one of a brush and a scraper for cleaning internal surfaces of a wellbore casing.

Embodiment 16. The anchor activation system according to any prior embodiment, further comprising: a whipstock mechanically connected to the housing.

Embodiment 17. A method of activating an anchor with an anchor activation system, the method comprising: introducing a first activation force to a trigger; sensing that the first activation force did not activate the anchor; and introducing a second activation force to the trigger without reconfiguring the anchor activation system to activate the anchor.

Embodiment 18. The method according to any prior embodiment, wherein introducing the first activation force includes increasing annular pressure about the anchor activation system.

Embodiment 19. The method according to any prior embodiment, further comprising rupturing a burst disc with the annular pressure.

Embodiment 20. The method according to any prior embodiment, further comprising urging a piston radially outwardly thereby releasing a constrained energy source.

Embodiment 21. The method according to any prior embodiment, wherein releasing the constrained energy source includes releasing a coil spring.

Embodiment 22. The method according to any prior embodiment, wherein introducing the first activation force includes increasing internal pressure of a tubular supporting the anchor.

Embodiment 23. The method according to any prior embodiment, wherein introducing the second activation force includes increasing internal pressure of a tubular supporting the anchor.

Embodiment 24. The method according to any prior embodiment, further comprising urging a piston radially outwardly with the internal pressure to release a constrained energy source.

Embodiment 25. The method according to any prior embodiment, wherein introducing the second activation force includes increasing annular pressure about a tubular supporting the anchor.

Embodiment 26. The method according to any prior embodiment, wherein introducing the second activation force includes contacting a portion of a piston assembly with a surface of a wellbore.

Embodiment 27. The method according to any prior embodiment, wherein contracting the portion of the piston assembly with a surface of the wellbore includes shifting the piston assembly into contact with an activator to activate the anchor.

Embodiment 28. The method according to any prior embodiment, further comprising sensing that the second activation force did not set the anchor; and introducing a third activation force without reconfiguring the anchor activation system to set the anchor.

Embodiment 29. The method according to any prior embodiment, wherein introducing the third activation force includes contacting a piston assembly with a wellbore surface; and shifting a slip ram mounted to an activator into contact with the anchor.

Embodiment 30. A method of activating an anchor with an anchor activation system, the method comprising: positioning a whipstock at a first position in a wellbore; introducing an activation force to a trigger thereby releasing a constrained energy source; shifting a slip with the constrained energy source into contact with a wellbore surface; and rotating the anchor after shifting the slip into contact with the wellbore surface.

Embodiment 31. The method according to any prior embodiment, further comprising relocating the whipstock to a second position in the wellbore that is higher than the first position and securing the whipstock in the second position by applying set down weight.

Embodiment 32. The method according to any prior embodiment, wherein the whipstock is at a different angular orientation when it is set than when it is activated.

Embodiment 33. The method according to any prior embodiment, further comprising milling a window in a casing disposed in the wellbore.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An anchor activation system comprising:

a housing including an outer surface, an inner surface defining an internal chamber, a first end, and a second end;

a slip shiftably mounted to the outer surface of the housing;

a piston assembly;

an activator mounted to the piston assembly, the activator selectively shifting the slip axially along the housing;

a biasing member arranged between the second end and the activator;

a piston cylinder extending radially through the outer surface of the housing to the internal chamber; and a trigger comprising a piston arranged in the piston cylinder and a shear element affixing the piston in the piston cylinder, wherein the trigger is operable to selectively release the piston assembly upon release of the piston.

2. The anchor activation system according to claim 1, wherein the piston assembly includes a first piston element and a second piston element, the first piston element including a first end engaged with the trigger and a second end extending into the activator.

3. The anchor activation system according to claim 2, wherein the second piston element includes a first end portion extending into the activator and a second end portion projecting axially outwardly of the housing.

4. The anchor activation system according to claim 1 further comprising: a slip ram extending between the activator and the slip.

5. The anchor activation system according to claim 1, wherein the biasing member comprises a constrained energy device.

6. The anchor activation system according to claim 5, wherein the constrained energy device comprises a spring.

7. The anchor activation system according to claim 1, further comprising: a trigger passage extending though the housing and fluidically connected to the piston cylinder.

8. The anchor activation system according to claim 7, further comprising: a burst disc arranged in the trigger passage.

9. The anchor activation system according to claim 1, wherein the piston assembly includes a first end selectively abutting the trigger and a second end that extends axially outwardly of the housing.

10. The anchor activation system according to claim 9, wherein the piston assembly includes a step portion arranged between the first end and the second end, the step portion supporting the activator.

11. The anchor activation system according to claim 10, wherein the activator directly abuts the slip.

12. The anchor activation system according to claim 1, further comprising: a tubular mechanically connected to the housing, the tubular supporting one of a brush and a scraper for cleaning internal surfaces of a wellbore casing.

13. The anchor activation system according to claim 1, further comprising: a whipstock mechanically connected to the housing.

* * * * *